US008051571B2

(12) United States Patent
Andis et al.

(10) Patent No.: US 8,051,571 B2
(45) Date of Patent: Nov. 8, 2011

(54) HAIR CLIPPER WITH BLADE ASSEMBLY RELEASE

(75) Inventors: Matthew L. Andis, Racine, WI (US); Richard J. Tringali, Racine, WI (US); Andrew A. Skuhra, Racine, WI (US)

(73) Assignee: Andis Company, Sturtevant, WI (US)

( * ) Notice: Subject to any disclaimer, the term of this patent is extended or adjusted under 35 U.S.C. 154(b) by 533 days.

(21) Appl. No.: 11/215,644

(22) Filed: Aug. 30, 2005

(65) Prior Publication Data

US 2007/0044604 A1 Mar. 1, 2007

(51) Int. Cl.
*B26B 13/00* (2006.01)
*B26B 19/06* (2006.01)

(52) U.S. Cl. ..... 30/210; 30/216; 30/223

(58) Field of Classification Search ..... 30/216, 30/220, 201, 195, 194, 223, 341, 342, 215, 30/228, 236, 210; 83/13
See application file for complete search history.

(56) References Cited

U.S. PATENT DOCUMENTS

| | | | | | |
|---|---|---|---|---|---|
| 2,306,039 | A | * | 12/1942 | Cromonic | 30/201 |
| 3,222,781 | A | * | 12/1965 | Ulke et al. | 30/210 |
| 3,320,668 | A | * | 5/1967 | Pucino | 30/201 |
| 3,992,778 | A | * | 11/1976 | Urbush | 30/216 |
| 4,581,822 | A | | 4/1986 | Fujimura | |
| 4,631,825 | A | * | 12/1986 | Kuriyama et al. | 30/43.92 |
| 4,719,698 | A | | 1/1988 | Ninomiya et al. | |
| 5,325,589 | A | | 7/1994 | Kubo | |
| 6,079,103 | A | | 6/2000 | Melton et al. | |
| 6,279,234 | B1 | | 8/2001 | Chaouachi et al. | |
| 6,684,507 | B2 | * | 2/2004 | Lau et al. | 30/34.1 |
| 6,862,810 | B2 | * | 3/2005 | Braun et al. | 30/210 |
| 7,395,599 | B2 | * | 7/2008 | Onion | 30/159 |
| 7,472,483 | B2 | * | 1/2009 | Beugels | 30/43.4 |
| 7,540,089 | B2 | * | 6/2009 | Oswald et al. | 30/43.1 |
| 2002/0092178 | A1 | | 7/2002 | Fung | |
| 2002/0162226 | A1 | | 11/2002 | Abraham et al. | |

* cited by examiner

*Primary Examiner* — Boyer D Ashley
*Assistant Examiner* — Omar Flores Sanchez
(74) *Attorney, Agent, or Firm* — Michael Best & Friedrich LLP

(57) ABSTRACT

A hair clipper includes a housing and a blade assembly coupled to the housing. The blade assembly is coupled to the housing at a cutting end and is movable between an operating position and an open position. The clipper also includes a release assembly including a release mechanism. The release assembly is switchable between a hold state and a release state. In the hold state, the release assembly holds the blade assembly in the operating position. In the release state, upon application of a force on the release mechanism, the release assembly releases the blade assembly to permit the blade assembly to move to the open position in the absence of an additional force.

13 Claims, 4 Drawing Sheets

HAIR CLIPPER WITH BLADE ASSEMBLY RELEASE

FIELD OF THE INVENTION

The invention relates generally to hair clippers and to arrangements for selectively releasing blade assemblies of such hair clippers.

BACKGROUND OF THE INVENTION

A blade assembly of a hair clipper typically includes a blade set having a fixed blade in face-to-face relation with a movable blade. An electric motor is drivingly connected to the movable blade to effect reciprocation thereof in response to actuation of the motor. A number of suitable motors and driving arrangements are known.

Hair clipper performance can generally be improved by cleaning cut hairs from around the blade set and the driving arrangement and by lubricating the blade set and the driving arrangement. To allow for this, the blade assembly is often configured to be movable from an operating position to an open position such that the blade set and the driving arrangement are exposed. Such movement also allows for the performance of other maintenance on the blade set and the driving arrangement.

In the past, blade assemblies had to be released and moved away from the housing through a direct manual force on the blade assembly, or by directly disengaging a hook from a corresponding recess in the lower front end of the housing.

SUMMARY OF THE INVENTION

A first embodiment of the present invention is directed to a hair clipper including a housing, and a blade assembly coupled to the housing. The blade assembly is movable between an operating position and an open position. The hair clipper also comprises a motor supported by the housing and drivingly connected to the blade assembly when the blade assembly is in the operating position, and a release assembly including a release mechanism, the release assembly switchable between a hold state and a release state, wherein in the hold state the release assembly holds the blade assembly in the operating position, and in the release state, upon application of a force exerted by an operator on the release mechanism, the release assembly releases the blade assembly to permit the blade assembly to move to the open position in the absence of an additional force from the operator.

Another embodiment of the present invention is directed to a hair clipper including a housing having a cutting end. The hair clipper also comprises a blade assembly coupled to the housing at the cutting end, the blade assembly movable between an operating position and an open position. An attachment assembly is at least partially disposed in the housing for coupling the blade assembly to the housing and biasing the blade assembly to the open position. A motor is supported by the housing and is drivingly connected to the blade assembly when the blade assembly is in the operating position. The hair clipper also comprises a release assembly having a release mechanism, the release assembly switchable between a hold state and a release state, wherein in the hold state the release assembly holds the blade assembly in the operating position, and in the release state, upon application of a force on the release mechanism, the release assembly releases the blade assembly such that the blade assembly moves to the open position.

The present invention is also directed to a method of removing a blade assembly from engagement with a housing of a hair clipper. The method comprises providing the hair clipper with an attachment assembly supporting the blade assembly for movement relative to the housing between an operating position and an open position and biasing the blade assembly to the open position. A release assembly has a release mechanism, the release assembly being switchable from a hold state to a release state wherein in the hold state the release assembly holds the blade assembly in the operating position and wherein in the release state the release assembly releases the blade assembly to permit the attachment assembly to bias the blade assembly to the open position. A force is applied to the release mechanism while the blade assembly is in the operating position to switch the release assembly from the hold state to the release state, whereby the release permits the attachment assembly to move the blade assembly to the open position. The method also comprises removing the blade assembly from the housing while the blade assembly is in the open position.

The invention also provides a hair clipper comprising a housing, a blade assembly including a frame and first and second blades supported by the frame, with at least one of the blades being movable relative to the other, the housing having thereon one of a projection and a recess, and the frame including the other of the projection and the recess, the projection being insertable in the recess, the one of the projection and the recess being mounted on the housing for movement such that, when the projection is inserted in the recess, the blade assembly is movable between an operating position and an open position, and the one of the projection and the recess being biased such that a biasing force biases the blade assembly toward the open position, a motor supported by the housing and drivingly connected to the blade assembly when the blade assembly is in the operating position, and a release mechanism supported by the housing for movement between hold and release positions, the release mechanism being biased to the hold position, and being movable by an operator to the release position, the release mechanism holding the blade assembly in the operating position when the release mechanism is in the hold position, and the release mechanism allowing the blade assembly to move to the open position under the influence of the biasing force when the release mechanism is in the release position, the blade assembly being removable from the housing by removing the projection from the recess when the blade assembly is in the open position.

Further objects of the present invention, together with the organization and manner of operation thereof, will become apparent from the following detailed description of the invention when taken in conjunction with the accompanying drawings wherein like elements have like numerals throughout the drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
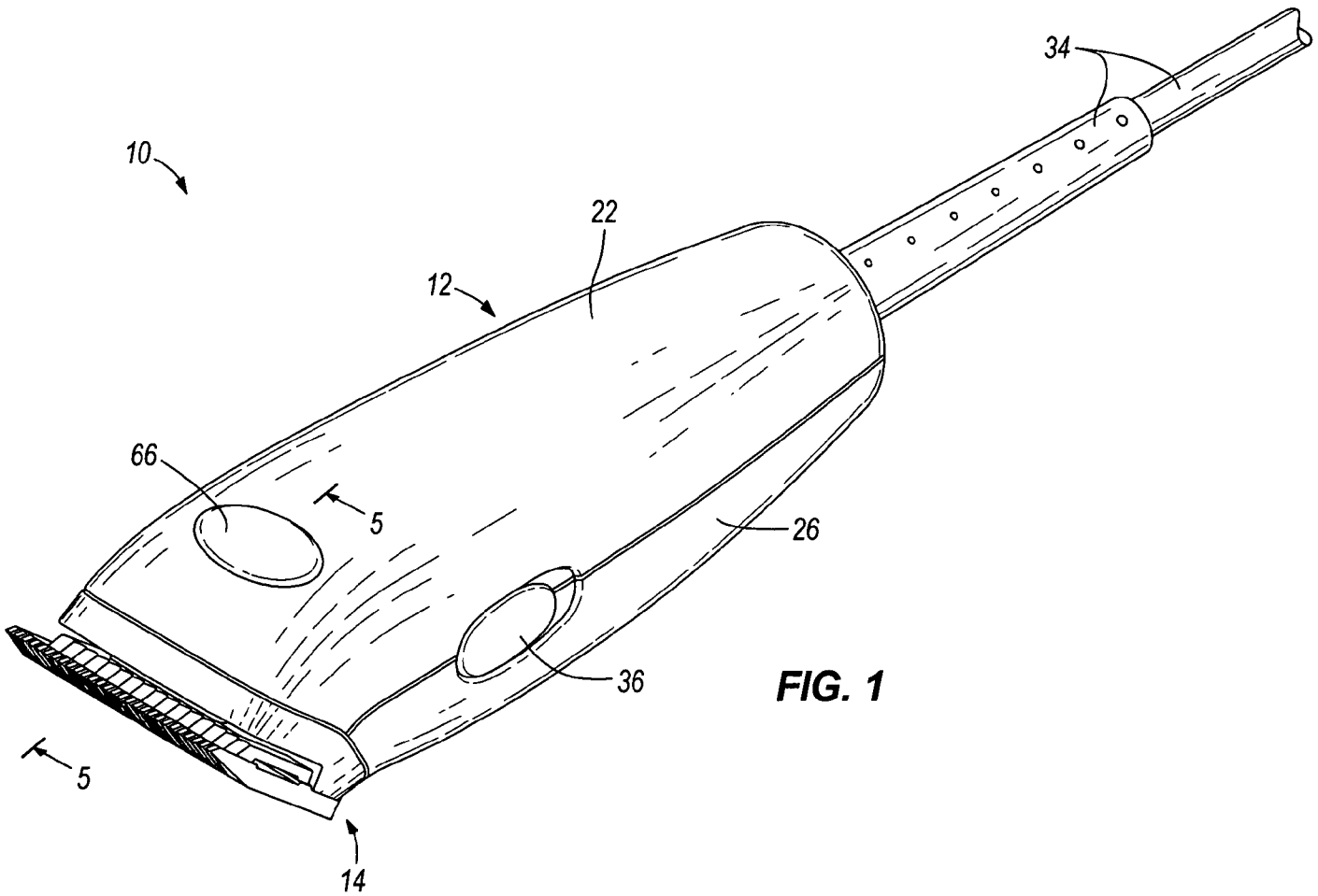
FIG. 1 is a perspective view of a hair clipper embodying various features of the invention, including a blade assembly in contact with a housing.
Figure 2:
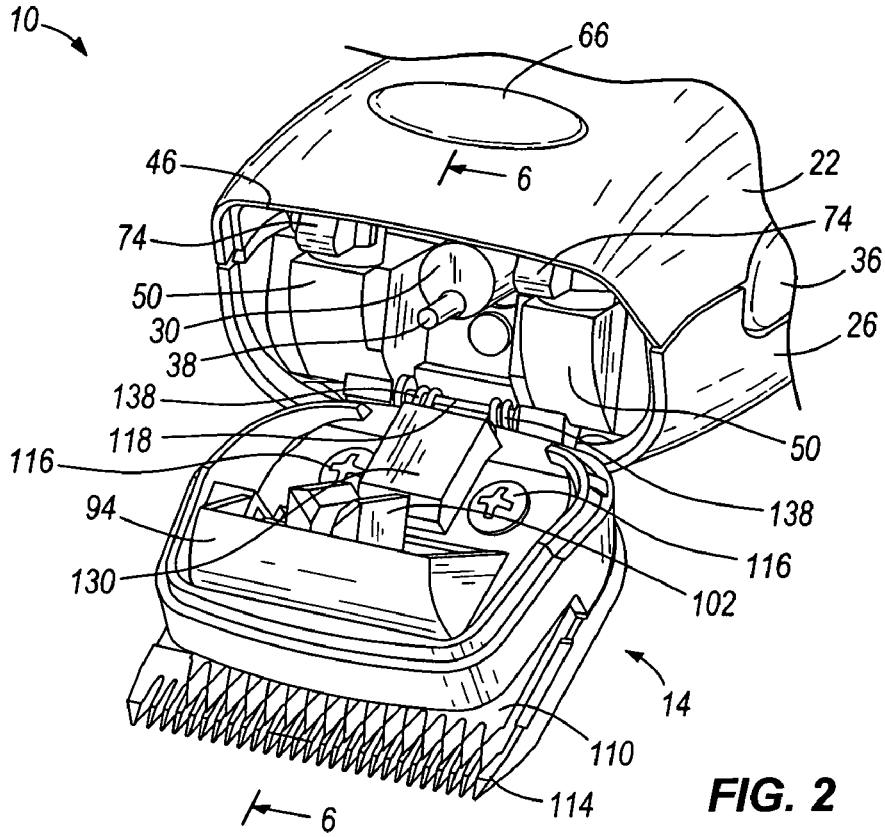
FIG. 2 is another perspective view of a portion of the hair clipper shown in FIG. 1, including the blade assembly pivoted away from the housing.
Figure 3:
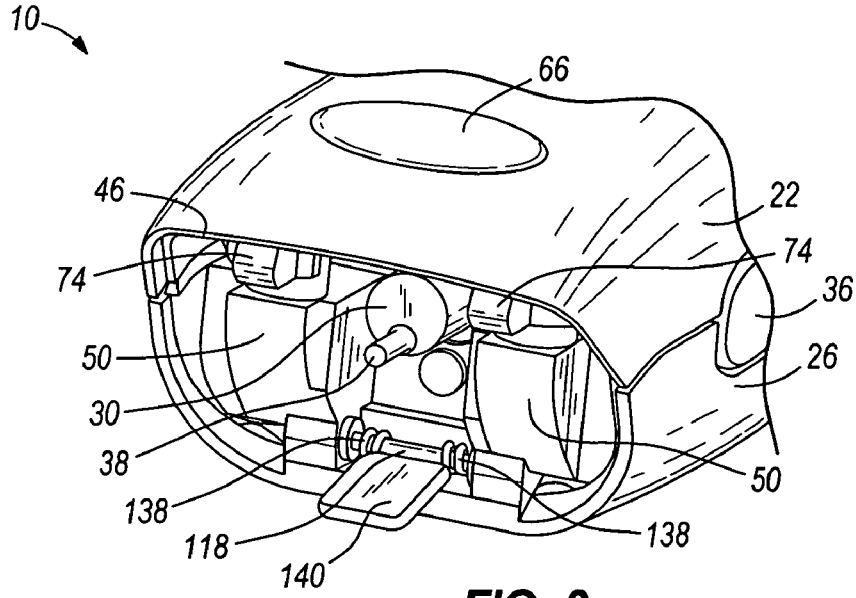
FIG. 3 is another perspective view of a portion of the hair clipper shown in FIG. 1 with the blade assembly removed from the housing.
Figure 4:
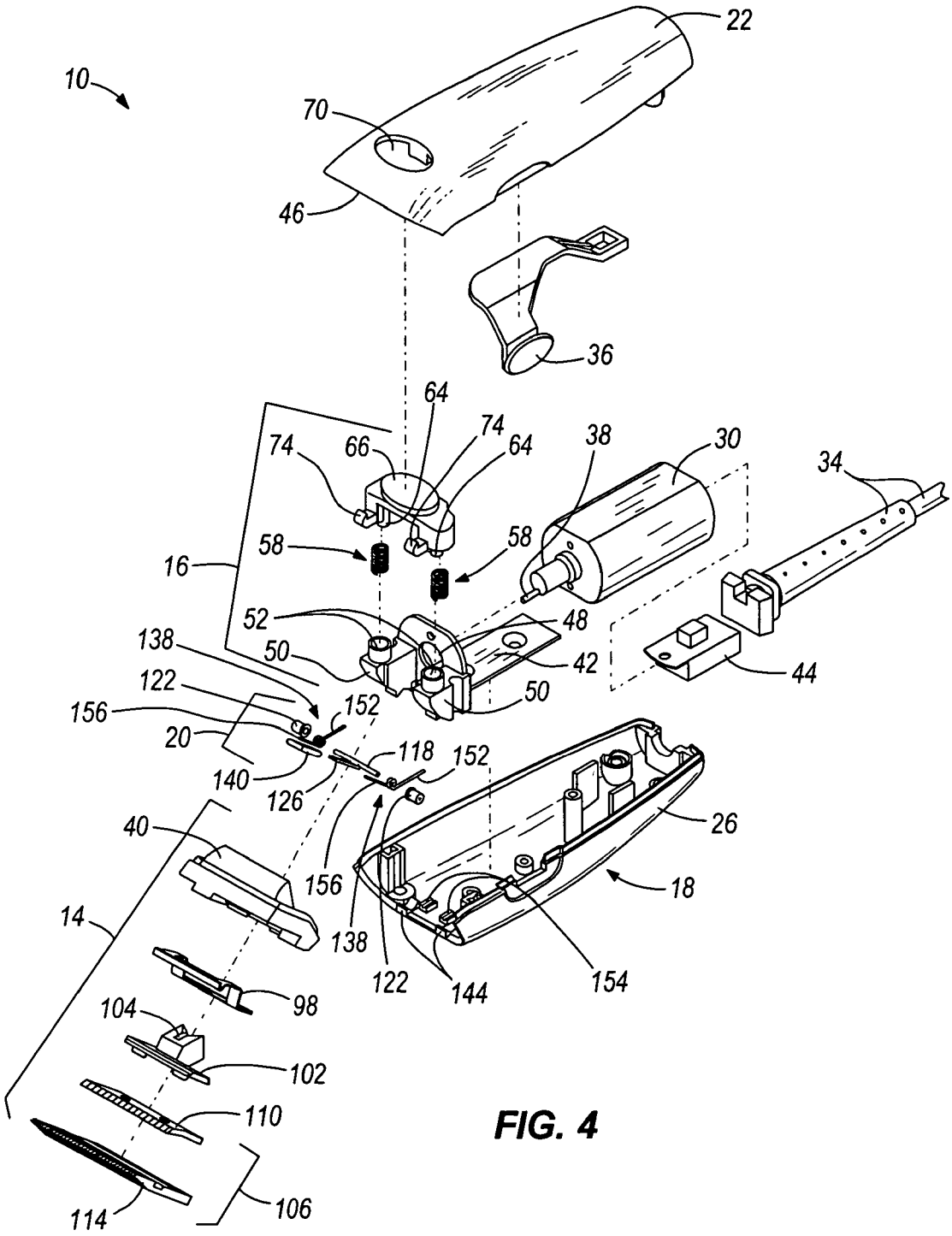
FIG. 4 is an exploded view of the hair clipper shown in FIG. 1.

A hair trimmer or clipper 10 according to the present invention is illustrated in FIGS. 1-6. The clipper 10 includes a housing 12 comprising an upper housing 22 and a lower housing 26. The housing 12 is preferably made of injection-molded plastic, but can be made of any suitable material as in known in the art. The housing includes a cutting end 46 (shown in FIGS. 2-6) and an opening 70 (shown in FIG. 4). As illustrated in FIG. 4, the lower housing 26 includes two seats 144 and two seats 154. The upper housing 22 and the lower housing 26 enclose an electric motor 30. An eccentric 38 is mounted on the output shaft of the motor 30. A cord 34 provides electricity to the electric motor 30 via a switch 44 mounted in the lower housing 26. An on/off switch actuator 36 is positioned for sliding movement along the side of the housing 12. The switch 36 actuator is coupled to the switch 44 for activating and deactivating the motor 30 to turn the clipper 10 on and off, respectively. Many alternative devices and mechanisms can be used to turn the clipper 10 on and off, as well known in the art, and can be used as a substitute to the mechanism illustrated in FIGS. 1-6.

Figure 5:
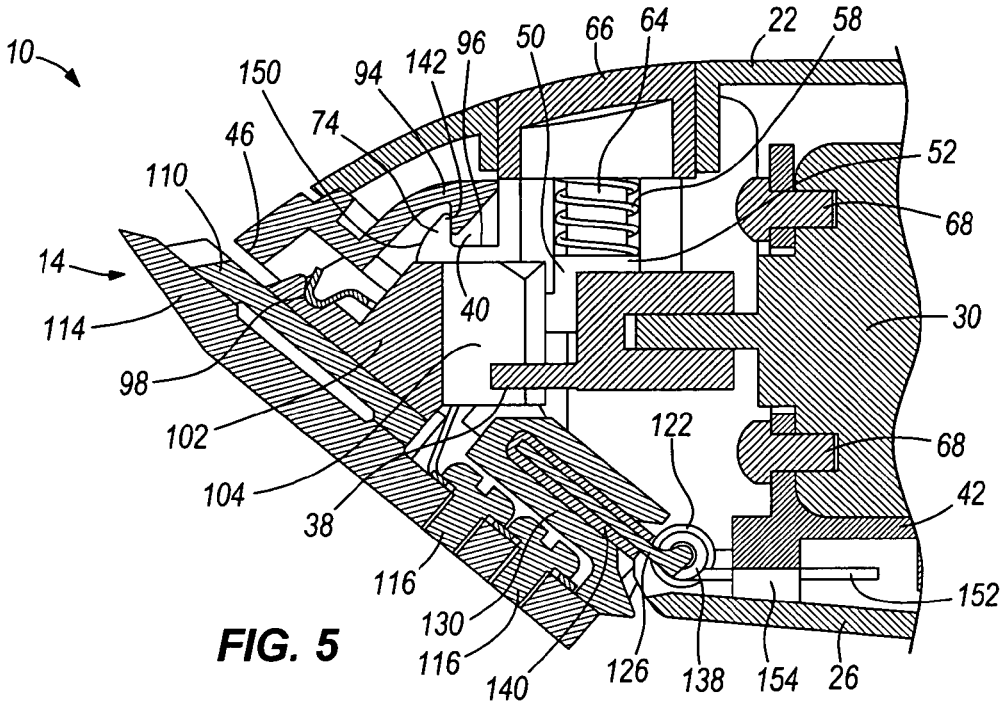
FIG. 5 is a cross-sectional view of the hair clipper taken along line 5-5 of FIG. 1.
Figure 6:
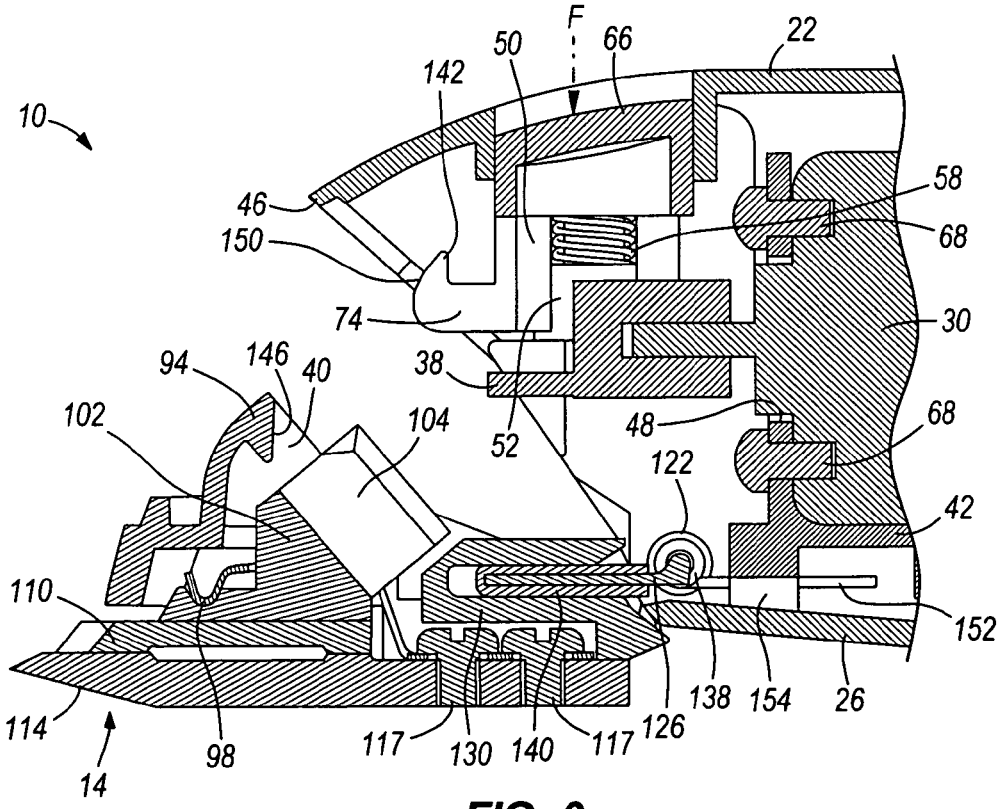
FIG. 6 is another cross-sectional view of the hair clipper taken along line 6-6 of FIG. 2.

As shown in FIGS. 4-6, a support bracket 42 is coupled to the lower housing 26 with fasteners (not shown). The support bracket 42 supports the motor 30 and is fastened to the motor 30 by screws 68. Any conventional fastener can be employed to secure the support member 42 to the motor 30 as just described, such as nails, rivets, pins, posts, clips, clamps, inter-engaging elements, and any combination of such fasteners. The support bracket 42 includes two extension portions 50, each having a recess 52. The purpose of the recesses 52 is explained below. In the illustrated embodiment, the recesses 52 are generally cylindrical. An aperture 48 is located between the extension portions for receiving a portion of the motor 30. The support bracket 42 shown in the illustrated embodiment is molded from plastic. In other embodiments, the support bracket 42 can be formed of a different material or combination of materials.

As illustrated in FIG. 4, a blade assembly 14 is located proximate the cutting end 46 of the upper housing 22. The blade assembly 14 includes a blade frame 40 to support the components of the blade assembly 14. The blade frame 40 includes a ridge 94 having a cam surface 146 (shown in FIG. 6), the reasons for which are explained below.

The blade assembly 14 also includes a blade set 106 having an inner blade 110 and an outer blade 114. The inner blade 110 is moves relative to the outer blade 114, which is fixed. The outer blade 114 is coupled to the blade frame 40 by screws 116 (FIG. 2), although any suitable fastener can be employed to secure the outer blade 114 to the blade frame 40. The inner blade 110 is coupled to a blade box 102 by screws (not shown) and is biased toward the outer blade 114 by a biasing spring 98. The spring 98 is fixed to the outer blade 114 by screws 117 (FIG. 6). A portion 104 of the blade box 102 receives the eccentric 38, and the inner blade 110 and the blade box 102 are supported such that the inner blade 110 moves back and forth across the outer blade 114 in response to movement of the eccentric 38, as is known in the art. The blade frame 40 also includes a tongue receiving member 130 (shown in FIGS. 5-6).

As illustrated in FIG. 4, an attachment assembly 20 includes a tongue 126 for insertion into the tongue receiving member 130 of the blade frame 40. The tongue 126 has thereon a sleeve 140 to help create a more snug fit between the tongue 126 and the tongue receiving member 130, and to couple torsion springs 138 to the tongue 126 (discussed below). As shown in FIGS. 3-4, the tongue 126 is generally a flat, rigid piece of plastic or metal fixed to a shaft 118. In this embodiment, the tongue 126 is molded to the shaft 118. In other embodiments, the tongue 126 may be fastened or otherwise linked to the shaft 118 for movement with or about the shaft 118. The shaft 118 is supported on either end by reservoir cups 122. The reservoir cups 122 are seated in the seats 144 of the lower housing 26 and are trapped or held in the seats by downwardly extending portions of the bracket 42, as best shown in FIG. 3. Preferably, the reservoir cups 122 are filled with lubricant (not shown), such as oil, binders with graphite or Teflon, ethers, silicones, or any such lubricant that dampens the rotation of the shaft 118.

Along the shaft 118, the tongue 126 is surrounded on either side by two torsion springs 138. A first end 152 of each spring 138 fits within a respective seat 154 of the lower housing 26. The ends 152 of the springs 138 are trapped or held in the seats 154 by downwardly extending portions of the bracket 42, as shown in FIGS. 5 and 6. The other ends 156 of the springs 138 extend into the sleeve 140, so that the sleeve 140 is biased to pivot in the counterclockwise direction as viewed in FIGS. 5 and 6. When the sleeve 140 is inserted in the tongue receiving member 130 of the blade frame 40, the entire blade assembly is biased in the counterclockwise direction as viewed in FIGS. 5 and 6. The attachment assembly 20 supports the blade assembly 14 for pivotal movement relative to the housing 12 between an operating position (FIG. 5) and an open position (FIG. 6). The springs 138 bias the blade assembly toward the open position.

The clipper 10 also includes a release assembly 16. The release assembly 16 includes a release mechanism 66. In the embodiment illustrated in FIGS. 1-6, the release mechanism 66 can include a button, a switch, a detent, or any similar device used to allow the state of a device to change. The release mechanism is preferably made of injection molded plastic and includes a button that extends through aperture 70 of the upper housing 22. The release mechanism 66 also includes two hooks 74 each including a top edge 142 and cam surfaces 150. The purpose of the hooks 74 is explained below.

The release mechanism also includes two downwardly extending projections or shafts 64, each of which is vertically aligned with and extends into a respective recess 52 in the bracket 42. Surrounding each 64 and extending into the associated recess 52 is a respective spring 58. The upper end of each spring 58 contacts the underside of the release mechanism 66, such that the springs 58 bias the release mechanism 66 upward. Upward movement of the release mechanism is limited by engagement of a shoulder on the release mechanism with the underside of the upper housing 26. This is the upper position of the release mechanism.

The release assembly 16 generally has two states, a hold state (shown in FIG. 5) and a release state (shown in FIG. 6). The hold state occurs in the absence of a downward force on the button 66. As illustrated in FIG. 5, in the hold state of the release assembly 16, the release mechanism is in its upper position, and the hooks 74 are engaged with the ridge 94 of the blade frame 40 to hold the blade assembly 14 in its operating position. The ridge 94 is held within the hooks 74 until force is applied to the release mechanism 66 to move the release mechanism downward, so that the release assembly is in its release state. By pushing the button 66 downward and thereby moving the hooks 74 downward, the hooks 74 are disengaged with the ridge 94 to allow the blade assembly to pivot to its open position. When the force on the button is removed, the springs 58 bias the release mechanism 66 back to the hold state. In other embodiments, a force applied to the release mechanism 66 can be in any direction to cause the release mechanism 66 and hooks 74 to move from the hold state to the release state. Alternatively, the release mechanism 66 can be pivoted, moved in a horizontal direction, moved in a vertical direction, or the like to move from the hold state to the release state.

As illustrated in FIGS. 5 and 6, in moving toward the open position, the blade assembly 14 pivots about the shaft 1118. The lubricant in the reservoir cups 122 dampens the pivoting motion of the blade assembly 14. When the shaft 1118 has rotated a specific amount, the blade assembly 14 will cease rotation when the springs 138 are in a free state (i.e., no force is applied to the blade assembly 14 by the springs 138).

During trimming operation of the clipper 10, the user operates the clipper 10 with the blade assembly 14 in the operating position. For cleaning and replacement purposes, the blade assembly 14 is removable from the housing 12 of the clipper 10, as illustrated in FIG. 3. To remove the blade assembly 14 from the housing 12, downward force F is first applied to the release mechanism 66. The force F on the release mechanism 66 causes the release mechanism 66 and the hooks 74 to move downward against the force of the springs 58. When the release mechanism 66 is lowered vertically to a point where the top edge 142 of each hook 74 is no longer in contact with the ridge 94 of the blade assembly 14, the blade assembly 14 then begins pivoting toward the open position.

In the open position, the blade assembly 14 is capable of being removed from the housing 12. By pulling the blade assembly 14 away from the attachment assembly 20, the tongue receiving member 130 of the blade assembly 14 is detached from the tongue 126 of the attachment assembly 20 and thereby from the housing 12. The blade set 106 of the blade assembly 14 may then be cleaned, repaired, or replaced.

The blade assembly 14 can be re-coupled to the attachment assembly 20 by inserting the tongue 126 and sleeve 140 into the tongue receiving portion 130 of the blade assembly 14. The user can then pivot the blade assembly 14 clockwise as seen in FIG. 6, against the force of the springs 138, toward the closed or operating position. As the blade assembly approaches the operating position, the cam surface 146 of the ridge 94 engages the cam surfaces 150 of the hooks 74 and thereby causes the hooks 74 to pull the release mechanism 66 downward, against the force of the springs 58, to allow the blade assembly to move fully to the operating position. After the ridge 94 clears the hooks 74, the springs 58 push the release mechanism upward to its upper position, in which the hooks 74 engage the ridge 94 and thereby secure the blade assembly 14 in the operating position. The release assembly 16 has then returned to the hold state.

The embodiments described above and illustrated in the figures are presented by way of example only and are not intended as a limitation upon the concepts and principles of the present invention. As such, it will be appreciated by one having ordinary skill in the art that various changes in the elements and their configurations and arrangement are possible without departing from the spirit and scope of the present invention as set forth in the appended claims.

What is claimed is:

1. A hair clipper comprising:

a housing;

a blade assembly coupled to the housing, the blade assembly movable between an operating position and an open position, the blade assembly including a ridge;

an attachment assembly pivotally interconnecting the housing and the blade assembly to enable pivotal movement of the blade assembly with respect to the housing between the operating position and the open position;

at least one torsion spring applying a torsional biasing force between the blade assembly and housing to bias the blade assembly toward the open position;

a motor supported by the housing, the motor including a motor shaft rotatable about an axis of rotation;

a drive element mounted on the motor shaft and engaging the blade assembly when the blade assembly is in the operating position, to drive operation of the blade assembly in response to operation of the motor; and a release mechanism including a hook, the release mechanism being supported for linear displacement in a first direction perpendicular to the motor shaft axis of rotation away from the motor shaft axis of rotation into a hold state and in a second direction perpendicular to the motor shaft axis of rotation toward the motor shaft axis of rotation into a release state;

wherein in the hold state, the hook of the release mechanism engages the ridge to hold the blade assembly in the operating position against the torsional biasing force of the torsion spring;

wherein upon application of a force exerted by a user on the release mechanism, the release mechanism displaces in the second direction such that the hook moves linearly to the release state to disengage the ridge of the blade assembly; and wherein the blade assembly automatically pivots to the open position, under the influence of the torsional biasing force of the torsion spring, when the hook disengages the ridge.

2. The hair clipper of claim 1, wherein when the blade assembly is in the open position, the blade assembly is removable from the housing.

3. The hair clipper of claim 1, further comprising a linear spring providing a linear biasing force to bias the release mechanism in the first direction toward the hold state.

4. The hair clipper of claim 3, wherein the release mechanism further includes a projection surrounded by the linear spring.

5. The hair clipper of claim 3, wherein the housing includes an opening; wherein the release mechanism includes a state-changing device that extends into the opening; and wherein the release mechanism is linearly actuated in the second direction against the linear biasing force of the linear spring by pushing, with a force directed in the second direction, the state-changing device into the housing through the opening.

6. The hair clipper of claim 5, wherein the ridge is positioned between the state-changing device and the hook when the blade assembly is in the operating position.

7. The hair clipper of claim 3, wherein the ridge includes a cam surface; wherein the hook includes a cam surface; wherein the cam surface of the ridge engages the cam surface of the hook in response to movement of the blade assembly from the open position into the operational position; wherein engagement of the cam surface of the hook by the cam surface of the ridge causes the release mechanism to displace linearly in the second direction against the linear biasing force for clearance of the ridge past the cam surface of the hook; and wherein the release mechanism displaces linearly in the first direction under the influence of the linear biasing force to engage the ridge upon the cam surface of the ridge clearing the cam surface of the hook.

8. The hair clipper of claim 1, wherein the hook of the release mechanism includes first and second hooks on opposite sides of the drive element; wherein both of the first and second hooks engage the ridge upon the release mechanism moving into the hold state with the blade assembly in the operating position.

9. The hair clipper of claim 8, further comprising:

a support bracket mounted to the motor and including first and second extension portions, each of the first and second extension portions including a recess opening in the first direction, the support bracket further including an aperture between the first and second extension portions, the drive element extending through the aperture such that the first and second extension portions are on opposite sides of the drive element; and first and second linear springs received in the respective first and second recesses of the support bracket first and second extension portions and extending in the first direction into engagement with the release mechanism;

wherein the linear springs apply a linear biasing force in the first direction on the release mechanism to bias the release mechanism toward the hold position.

10. The hair clipper of claim 1, wherein the hook extends parallel to the motor shaft axis of rotation and opens in the first direction.

11. A hair clipper comprising:

a housing including a cutting end, the housing including an opening;

a blade assembly coupled to the housing at the cutting end and including a ridge, the blade assembly movable between an operating position and an open position;

an attachment assembly including a shaft about which the blade assembly pivots;

first and second torsion springs mounted on the shaft, each of the first and second torsion springs having a first end engaging the housing and a second end engaging the blade assembly, such that the first and second torsion springs provide a torsional biasing force to bias the blade assembly toward the open position;

a motor supported by the housing, the motor including a motor shaft rotating about an axis of rotation;

wherein a first direction is defined as perpendicular to the motor shaft axis of rotation from the axis of rotation toward the opening in the housing and a second direction is defined as perpendicular to the motor shaft axis of rotation from the opening in the housing toward the axis of rotation;

a drive element mounted on the motor shaft and engaging the blade assembly when the blade assembly is in the operating position, to drive operation of the blade assembly in response to operation of the motor;

a support bracket mounted to the motor and including first and second extension portions, each of the first and second extension portions including a recess opening in the first direction, the support bracket further including an aperture between the first and second extension portions, the drive element extending through the aperture such that the first and second extension portions are on opposite sides of the drive element;

first and second linear springs received in the respective first and second recesses of the support bracket first and second extension portions and extending in the first direction;

a release mechanism including a state-changing device, first and second hooks integrally formed with the state-changing device, and first and second projections, the state-changing device being received within the opening of the housing, the first and second hooks extending parallel to the motor shaft axis of rotation and opening in the first direction, the hooks being disposed in the housing on either side of the drive element, the first and second projections extending in the second direction and being at least partially surrounded by the respective first and second linear springs;

wherein the release mechanism is linearly movable in the first direction toward a hold state and linearly movable in the second direction toward a release state;

wherein the linear springs apply a linear biasing force in the first direction on the release mechanism;

wherein in the hold state, the first and second hooks are biased by the linear biasing force into engagement with the ridge of the blade assembly to hold the blade assembly in the operating position against the torsional biasing force of the first and second torsion springs;

wherein upon application of a force in the second direction on the state-changing device, the release mechanism moves linearly in the second direction against the linear biasing force into the release state;

wherein movement of the release mechanism into the release state disengages the first and second hooks from the ridge to release the blade assembly; and wherein the torsional biasing force pivots the blade assembly moving to the open position upon release of the blade assembly to enable removal of the blade assembly.

12. The hair clipper of claim 11, wherein the opening is in a top surface of the housing.

13. The hair clipper of claim 11, wherein the blade assembly further comprises a tongue receiving member to receive a tongue portion of the attachment assembly and thereby couple the blade assembly to the housing.

* * * * *